US008807493B2

(12) United States Patent
Kamon, II

(10) Patent No.: US 8,807,493 B2
(45) Date of Patent: Aug. 19, 2014

(54) WHEELED BUCKET STAND

(76) Inventor: David Kamon, II, Fraser, MI (US)

( * ) Notice: Subject to any disclaimer, the term of this patent is extended or adjusted under 35 U.S.C. 154(b) by 0 days.

(21) Appl. No.: 13/117,178

(22) Filed: May 27, 2011

(65) Prior Publication Data

US 2011/0290961 A1 Dec. 1, 2011

Related U.S. Application Data

(60) Provisional application No. 61/396,505, filed on May 28, 2010.

(51) Int. Cl.
*A63B 55/08* (2006.01)

(52) U.S. Cl.
USPC ..... 248/98; 248/95; 248/97; 248/99; 248/129; 248/163.1

(58) Field of Classification Search
CPC ..... B65B 67/12; A47J 36/16; A47J 36/34
USPC ..... 248/150, 151, 152, 528, 165, 168, 129, 248/163.1; 220/628
See application file for complete search history.

(56) References Cited

U.S. PATENT DOCUMENTS

| | | | | |
|---|---|---|---|---|
| 2,509,284 | A * | 5/1950 | Allen | 248/149 |
| 3,771,752 | A * | 11/1973 | Meeh | 248/98 |
| 4,032,097 | A * | 6/1977 | Dwyer | 248/146 |
| 5,193,770 | A * | 3/1993 | Kildare | 248/97 |
| 5,232,188 | A * | 8/1993 | Troncone | 248/154 |
| 6,776,379 | B2 * | 8/2004 | Sherer et al. | 248/150 |

* cited by examiner

*Primary Examiner* — Amy J Sterling
(74) *Attorney, Agent, or Firm* — Matthew W. Mitchell; Mitchell Law PLLC

(57) ABSTRACT

A stackable wheeled bucket stand and method is disclosed. The bucket stand includes an elliptical support ring configured to support a bucket, a plurality of leg assemblies, each leg assembly connected to the support ring, and a plurality of wheels, each wheel connected to a leg.

12 Claims, 6 Drawing Sheets

WHEELED BUCKET STAND

CROSS REFERENCE TO RELATED APPLICATIONS

This application claims the benefit of U.S. Provisional Application No. 61/396,505 filed on May 28, 2010 which is hereby incorporated herein by reference.

TECHNICAL FIELD

This disclosure is related to containers and more particularly to elevation of a container.

BACKGROUND

The statements in this section merely provide background information related to the present disclosure and may not constitute prior art.

Containers and buckets are well known in the art and used and sold for many purposes. Some bucket types have become standard in the market place serving multi-purposes for individual and business needs. For example, 3.5 gallon and 5 gallon bucket sizes are well known and generally available in a standard type including height, diameter, bucket rim, and bucket ledge.

For many tasks it is convenient, more efficient, or less physically demanding to have an elevated container or bucket accessible when performing the task. It is known to place a bucket or container on tables, chairs, or other unattached and unadapted elevated planes. However, this may be cumbersome or impractical in many applications. Additionally, known methods do not include selective height adjustability or wheels for convenient movability. Therefore, it would be advantageous to provide a moveable, elevated bucket stand configured to adjust a bucket height.

Such an elevated bucket stand is particularly useful in horticulture applications as it allows for plants growing in a buckets or other compatible container to be elevated closer to lights source for less lumen loss, decreases physical bending or heavy lifting by bringing the plant up to a more comfortable level, permits for a drain bucket to be placed underneath for drain water collection, and makes moving plants placed in the elevated bucket a simple act.

SUMMARY

A stackable wheeled bucket stand and method is disclosed. The bucket stand includes an elliptical support ring configured to support a bucket, a plurality of leg assemblies, each leg assembly connected to the support ring, and a plurality of wheels, each wheel connected to a leg.

BRIEF DESCRIPTION OF THE DRAWINGS

One or more embodiments will now be described, by way of example, with reference to the accompanying drawings, in which.

DETAILED DESCRIPTION

Figure 1:
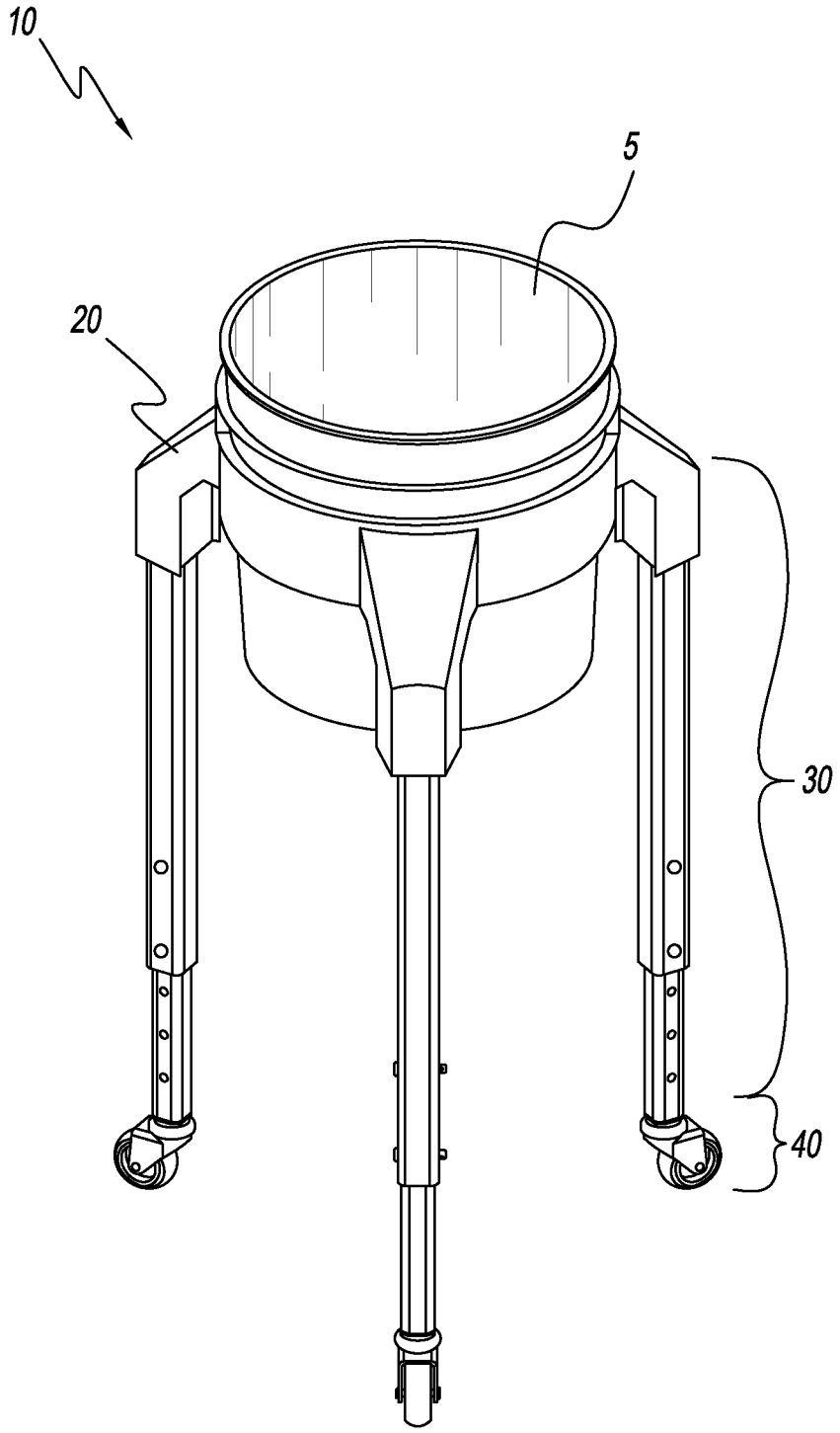
FIG. 1 shows a first embodiment of a stackable wheeled bucket stand, in accordance with the present disclosure.

Referring now to the drawings, wherein the showings are for the purpose of illustrating certain exemplary embodiments only and not for the purpose of limiting the same, FIG. 1 shows an exemplary stackable wheeled bucket stand 10. The bucket stand 10 includes an elliptical support ring 20 including cavities for leg attachments, wheel assemblies 40 and leg assemblies 30. The bucket stand 10 is configured to receive a bucket 5 by supporting a ledge of the bucket on the elliptical support ring 20 as described herein below. The bucket stand 10 is preferably configured to hold and aid in the movement of a round shaped bucket while allowing it to remain elevated at a desired height.

The bucket stand 10 is preferably adapted for a round shaped bucket with an unobstructed smooth lower ridge. Smooth unobstructed lower ridge refers to the bottommost ridge in the upper, outside portion of a bucket 5 being smooth and free of obstacles including but not limited to bucket handle supports, any molded reinforcements, or any obtrusion created from an aesthetic feature. In one embodiment, the bucket stand 10 is moveable along a floor or ground via 3 stem mount wheels such as the wheel assemblies 40 inserted into hollow core access point of the lower legs. Each wheel assembly in the exemplary embodiment will hold a third of the load and move on a smooth level surface. In one embodiment, wheels are configured to support a minimum of 60 lbs each. The bucket stand, once fully assembled stand can support at least 80 lbs of total weight from the round plastic bucket place upon it. In one embodiment, the stand is configured to receive a 5 gallon plastic bucket. In one embodiment, the stand is configured to receive a 3.5 gallon plastic bucket.

One skilled in the art will readily recognize that alternative embodiments of the disclosure may include multiple additional wheel assemblies including four or more wheels and associated leg assemblies. The number of the wheels and leg assemblies may be determined based upon bucket size, e.g., more wheels and leg assemblies for larger buckets.

Figure 2C:
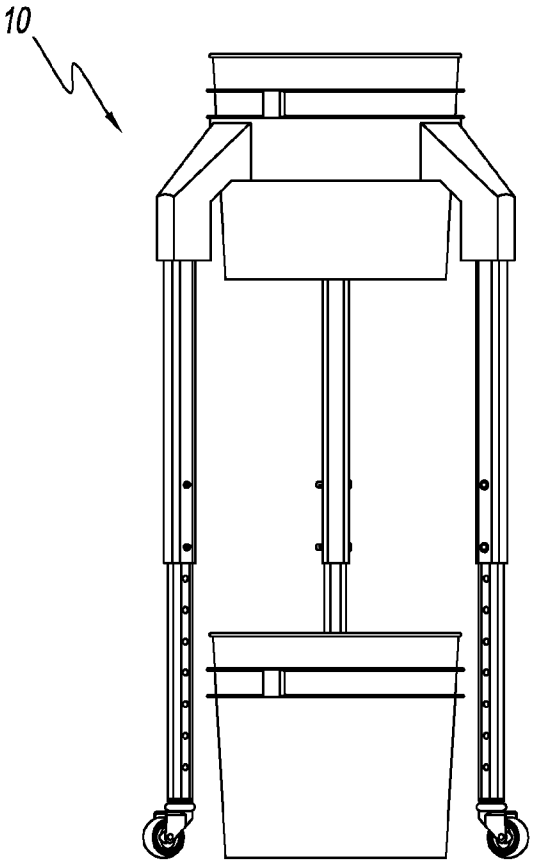
FIGS. 2A-2C show the a stackable wheeled bucket stand at a variety of adjusted heights, in accordance with the present disclosure.
Figure 2B:
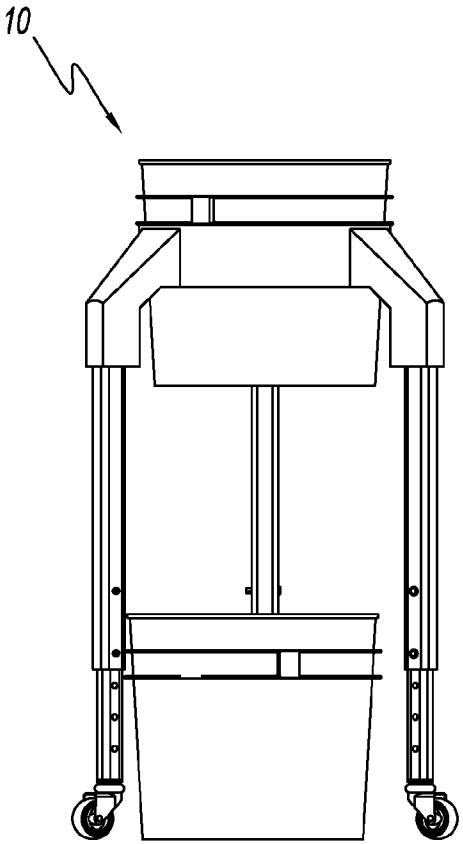
Figure 2A:
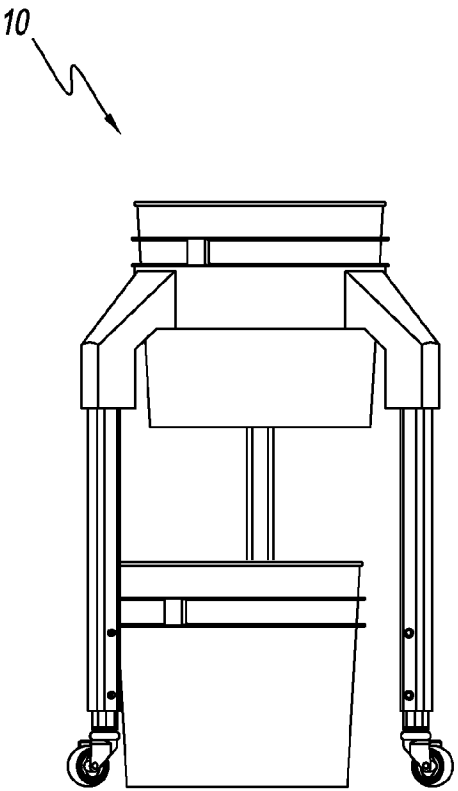
Figure 7:
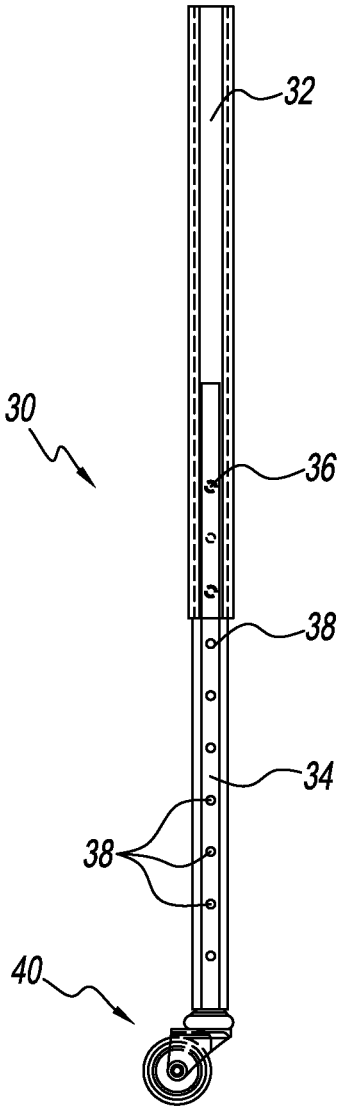
FIG. 7 shows a first embodiment of a leg, in accordance with the present disclosure.

FIGS. 2A-2C show the stackable wheeled bucket stand 10 at a variety of adjusted heights. Height of the bucket stand 10 is adjusted by utilizing adjustment holes within the leg assemblies 30 as shown in FIG. 1 and FIG. 7. Preferably, the bucket stand is configured to adjust to a height permitting another bucket to be placed underneath an elevated bucket used in the bucket stand. In one embodiment, the bucket stand 10 permits a round 3.5 or 5 gallon plastic bucket to be placed upon it while also allowing for an additional round 3.5 or 5 gallon plastic bucket to be placed underneath it, or alternately the stand to be rolled over an additional round 3.5 or 5 gallon plastic bucket. In this way, for a horticulture application, the bucket stand 10 may permit watering of a plant contained in the bucket 5 while water runoff may be caught in a bottom bucket.

Figure 3:
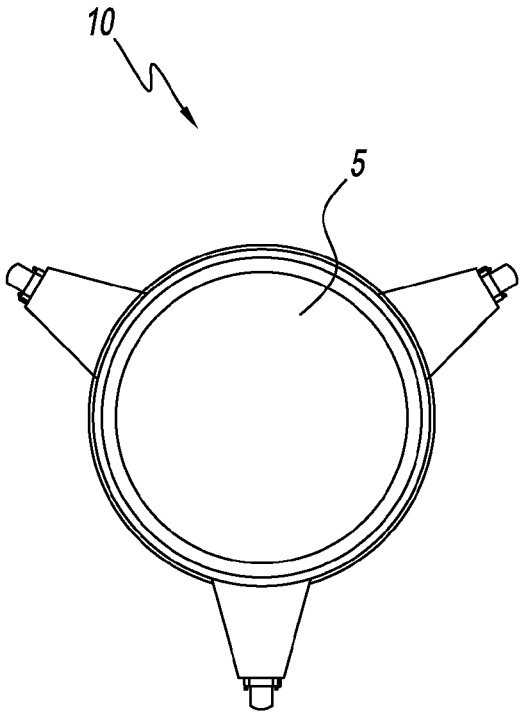
FIG. 3 show a top view of the stackable wheeled bucket stand, in accordance with the present disclosure.

FIG. 3 show a top view of the stackable wheeled bucket stand 10 including an exemplary bucket 5. The bucket 5 rests upon the bucket stand 10 utilizing a bucket ledge. As FIG. 3 shows, the leg assemblies are preferably spaced equidistant from one another along a circumference of the elliptical support ring. For example, in the exemplary three leg embodiment of the bucket stand 10, the leg assemblies may be space 120-degrees from one another for preferential support.

Figure 4:
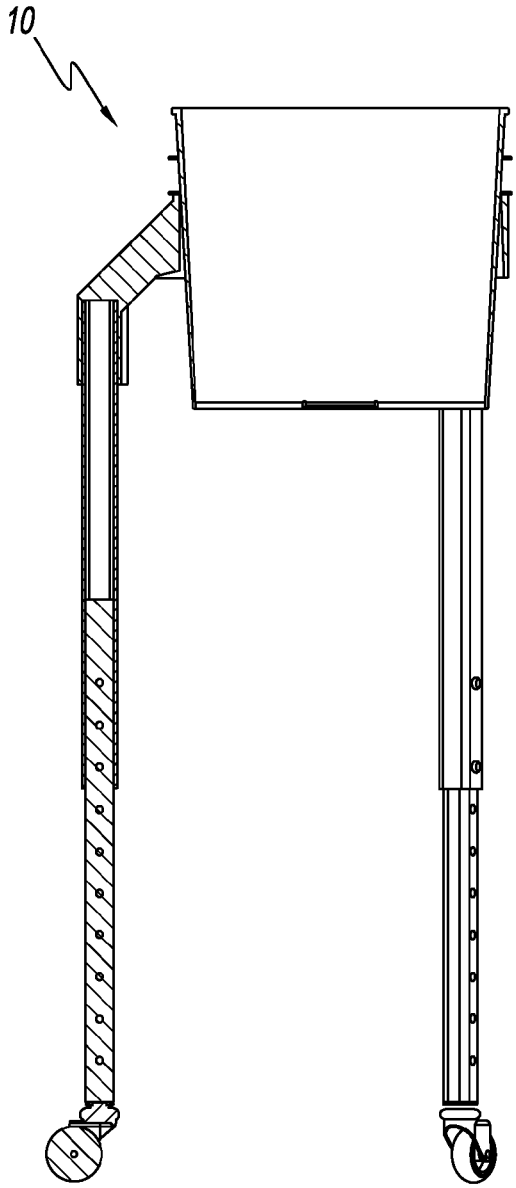
FIG. 4 shows a sectional view of the stackable wheeled bucket stand, in accordance with the present disclosure.

FIG. 4 shows a sectional view of the stackable wheeled bucket stand 10. As one skilled in the art will recognize, the leg assemblies are inserted into the molding of leg attachments contiguously connected to the elliptical support ring.

Figure 5:
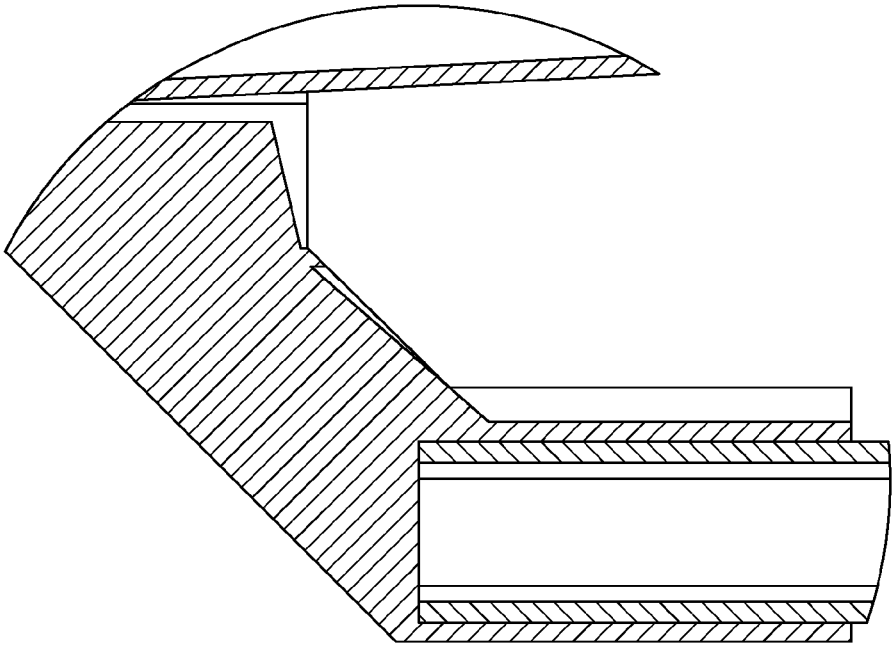
FIG. 5 is a sectional view of an elliptical support ring, in accordance with the present disclosure.
Figure 6:
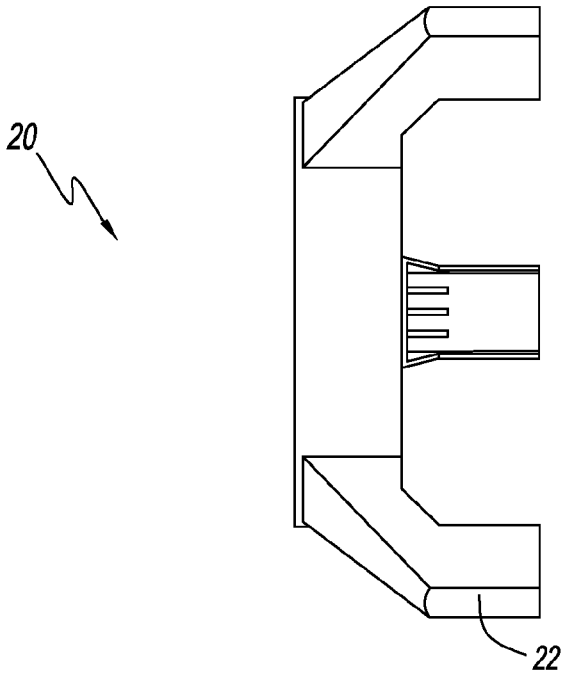
FIG. 6 shows the elliptical support ring, in accordance with the present disclosure.

FIG. 6 shows the elliptical support ring 20 including three exemplary leg housings 22. FIG. 5 shows a close-up, section view of a leg housing 22 with a leg assemblies attached within. The leg housings 22 are configured to receive the leg assemblies 30 using one or more known attachment methods such as frictional or force-based attachment means or secure mechanical-based attachment means such as a fastener, a nut and bolt assembly, tapered screws, and/or weld may additional be used. Those of ordinary skill in the relevant arts will understand and appreciate that multiple attachment means and fabrication methods may be used to assemble the leg assemblies to the elliptical support without departing from the present disclosure and is therefore not intended to be limited thereby. The elliptical support ring 20 is preferably a contiguous structure manufactured from plastic using an injection molding manufacturing process, although other manufacturing processes are contemplated by this disclosure including blow molding and fabrication processes.

The exemplary elliptical support ring 20 includes the 3 leg housings 22 which receive the leg assemblies 30. The elliptical support ring 20 holds weight of bucket upon its uppermost edge where it preferably contacts the full lowermost outer ridge of the bucket in the stand. The elliptical support ring 20 is configured to hold the bucket 5 in the bucket stand 10 to exert its load low and central within the bucket stand 10 and, with the assistance of the leg housing 22, secure each leg assembly during use of the bucket stand 10.

FIG. 7 shows an exemplary leg assembly 30 and an attached exemplary wheel assembly 40. In one embodiment, the wheel assembly 40 includes 3-2" stem mount wheels. The leg assembly 30 includes a receiving member 32 configured to receive a height adjustable member 34. The height adjustable member and receiving member each include at least one hole, and preferably multiple holes configured to receive a fastening means such as screws, or clevis or cotter pins. The fastening means are configured to hold the bucket stand 10 at a desired height.

Figure 8B:
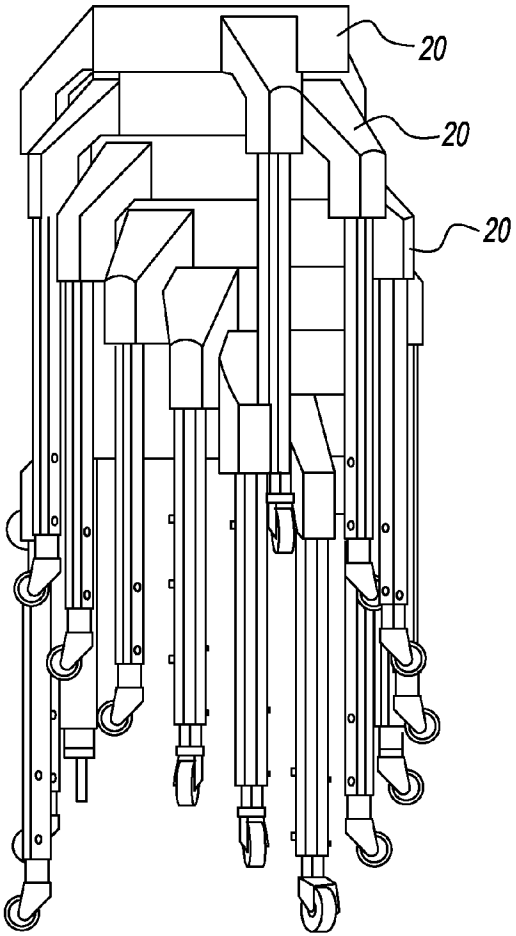
FIG. 8B shows a plurality of stackable wheeled bucket stands, in accordance with the present disclosure.
Figure 8A:
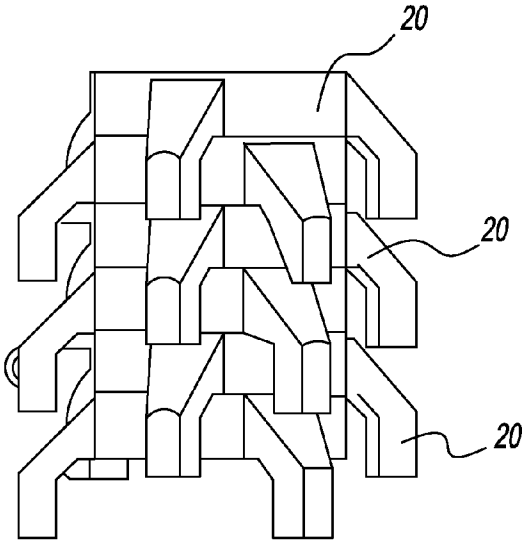
FIG. 8A shows a plurality of the elliptical support rings stacked, in accordance with the present disclosure.

FIGS. 8A and 8B show a plurality of the elliptical support rings 20 and complete bucket stands 10 in an exemplary stack. Storage space is a concern for businesses and individuals. The bucket stand 10 is configured to save space with the ability to stack one bucket stand on top of another bucket stand. The elliptical support rings 20 are also stackable for convenience during the manufacturing process or otherwise. The bucket stands 10 and elliptical support rings 20 are stackable by positioning the leg housing 22 as not to align or intersect another leg housing 22.

In one exemplary application, the bucket stand 10 is used for indoor horticultural activities, a 3.5 or 5 gallon round plastic bucket commonly used in indoor cultivation as well as many various other fields, to be accommodated. The height of the bucket stand 10 allows for a similar round plastic bucket to be placed underneath the stands suspended bucket or, alternatively, the bucket 5 placed on the bucket stand 10 to be wheeled over an empty bucket allowing for drainage collection from regular watering or required flushing of plants. This feature allows floors to stay clean and provides easy testing (PH or other) of collected drain water.

In operation, a round shaped 3.5 or 5 gallon plastic bucket or similarly shaped and configured bucket adapted for use with the bucket stand 10 is placed down through the top of the bucket stand 10 and wheeled around as needed. In one embodiment, the bucket stand 10 can be specifically designed for use with standard and conventional round 3.5 & 5 gallon plastic buckets that have a smooth, unobstructed lower ridge. Other embodiments may be adapted to accommodate buckets lacking an unobstructed lower ridge as well as several versions of similarly shaped round 3 & 6 gallon plastic buckets. For height adjustment, the legs may be pinned to the desired length within the available range. The completed bucket stands 10 may be stacked upon each other for convenient storage up to six high in one embodiment, the elliptical support rings can be stacked to an infinite height.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A bucket stand comprising:

a circular support ring configured to support a bucket, wherein the circular support ring comprises an upper support ledge configured to support a lower edge or rim of a bucket;

a plurality of leg housings contiguously and integrally connected to the support ring and extending outwardly from an exterior side surface of the support ring, the leg housings each having a hollow interior portion configured to receive a leg assembly member;

a plurality of leg assemblies, each leg assembly connected to the support ring via the plurality of integrally connected leg housings at a perpendicular angle, within the hollow interior portions of the leg housings; and a plurality of wheels, each wheel connected to a leg.

2. The bucket stand of claim 1, wherein the leg assemblies are selectively length adjustable; and wherein the leg housings proximately dispose the connected leg assembly from the exterior side of the support ring by at least the cross-sectional distance of the major axis of the leg assembly.

3. The bucket stand of claim 1, wherein the circular support ring is configured to set flush upon a second bucket stand.

4. The bucket stand of claim 2, wherein the leg assemblies comprise a receiving member configured to receive a height adjustable member.

5. The bucket stand of claim 4, wherein the height adjustable member is configured to receive a wheel assembly, wherein the wheel assembly comprises an attachment means and a wheel.

6. The bucket stand of claim 4, wherein the height adjustable member and receiving member each comprise at least one hole configured to receive a fastening means.

7. The bucket stand of claim 1, wherein each of the plurality of wheels comprises a stem mounted wheel.

8. The bucket stand of claim 1, wherein the circular support ring comprises a single contiguous piece.

9. A bucket stand comprising:

a circular support ring configured to support a bucket, and further configured to stack a second bucket stand flush upon the support ring;

a plurality of hollow leg housings integrally connected to an exterior side surface of the support ring, each configured to receive a leg assembly within a hollow interior therein at a distance from the support ring;

a plurality of height-adjustable leg assemblies, each leg assembly connected to the support ring at a 90-degree angle; and a plurality of wheels, each wheel connected to a leg assembly.

10. The bucket stand of claim 9, wherein the circular support ring is configured to set flush upon a second bucket stand.

11. The bucket stand of claim 9, wherein each of the plurality of wheels comprises a stem mounted wheel.

12. The bucket stand of claim 9, wherein the circular support ring comprises an upper support ledge configured to support a lower edge or rim of a bucket.

* * * * *